US007683867B2

(12) United States Patent
Inoue et al.

(10) Patent No.: US 7,683,867 B2
(45) Date of Patent: Mar. 23, 2010

(54) METHOD FOR CONTROLLING VIEWING ANGLE CHARACTERISTICS OF A LIQUID CRYSTAL DISPLAY

(75) Inventors: Kohji Inoue, Yamato (JP); Manabu Kodate, Yokohama (JP); Keita Ishii, Tokyo (JP); Rieko Kataoka, Sagamihara (JP)

(73) Assignee: Lenovo (Singapore) Pte. Ltd., Singapore (SG)

( * ) Notice: Subject to any disclaimer, the term of this patent is extended or adjusted under 35 U.S.C. 154(b) by 1072 days.

(21) Appl. No.: 11/336,553

(22) Filed: Jan. 20, 2006

(65) Prior Publication Data

US 2006/0164329 A1 Jul. 27, 2006

(30) Foreign Application Priority Data

Jan. 26, 2005 (JP) ..... 2005-018326

(51) Int. Cl.
*G09G 3/36* (2006.01)

(52) U.S. Cl. ..... 345/87; 345/88; 345/89

(58) Field of Classification Search ..... 345/204, 345/698, 98, 87–89; 349/178
See application file for complete search history.

(56) References Cited

U.S. PATENT DOCUMENTS

| | | | | |
|---|---|---|---|---|
| 5,717,906 | A * | 2/1998 | Aratani | 345/536 |
| 5,808,705 | A * | 9/1998 | Hishida et al. | 349/33 |
| 5,870,158 | A * | 2/1999 | Abe et al. | 349/111 |
| 5,956,107 | A * | 9/1999 | Hashimoto et al. | 349/64 |
| 6,208,396 | B1 * | 3/2001 | Shimizu et al. | 349/119 |
| 6,559,826 | B1 * | 5/2003 | Mendelson et al. | 345/102 |
| 2002/0149598 | A1 * | 10/2002 | Greier et al. | 345/589 |
| 2003/0146893 | A1 * | 8/2003 | Sawabe | 345/89 |
| 2004/0061711 | A1 * | 4/2004 | Kurumisawa et al. | 345/698 |
| 2004/0207594 | A1 * | 10/2004 | Kubo | 345/100 |
| 2005/0243265 | A1 * | 11/2005 | Winlow et al. | 349/178 |
| 2006/0044290 | A1 * | 3/2006 | Hurwitz et al. | 345/204 |

FOREIGN PATENT DOCUMENTS

| | | |
|---|---|---|
| JP | 2003-131230 | 5/2003 |
| JP | 2003-295160 | 10/2003 |
| JP | 2004-318112 | 11/2004 |

* cited by examiner

*Primary Examiner*—Amare Mengistu
*Assistant Examiner*—Koosha Sharifi
(74) *Attorney, Agent, or Firm*—Dillon & Yudell LLP

(57) ABSTRACT

A system, method, and computer-usable medium are presented for controlling viewing angle characteristics by performing a color palette gradation control of a liquid crystal display, such that adjustment effects on a viewing angle range are improved.

9 Claims, 11 Drawing Sheets

METHOD FOR CONTROLLING VIEWING ANGLE CHARACTERISTICS OF A LIQUID CRYSTAL DISPLAY

PRIORITY CLAIM

This application claims priority of Japanese Patent Application No.: 2005-18326, filed on Jan. 26, 2005, and entitled, "Information Processing Apparatus, Method of Controlling Display of Liquid Crystal Display, Program Product for Executing Method of Controlling Display, and Information Processing Apparatus with Improved Adjustment Effects on Viewing Angle Range."

BACKGROUND OF THE INVENTION

1. Technical Field

The present invention relates to a technique of controlling viewing angle characteristics of a liquid crystal display, and more particularly to an information processing apparatus, a method of controlling a display of a liquid crystal display, and a program for executing the method of controlling the display that provide a narrow viewing angle characteristic by controlling gradation of the liquid crystal display.

2. Description of Related Art

A liquid crystal display is used for an information processing apparatus, such as a laptop computer, a notebook computer, a PDA, and a mobile phone in many cases to thereby provide a display to a user. Particularly, in recent years, due to downsizing of the information processing apparatus, the information processing apparatus is increasingly used under a situation where persons other than the user are present within easy reach. Especially, information displayed on the liquid crystal display of a portable information processing apparatus includes privacy information in many cases, and therefore preferably the persons other than the user are prevented from being able to recognize the information.

Various kinds of methods for controlling a viewing angle in the liquid crystal display have been disclosed so far. For example, in Japanese Unexamined Patent Publication (Kokai) No. 2003-295160, there is disclosed a liquid crystal display in which high contrast is provided even in a wide viewing angle by adjusting distortion due to a viewing angle of a gradation curve on a display screen, and on the contrary, by providing a display image with an narrow viewing angle, information that user does not want to be seen by others is displayed. In Japanese Unexamined Patent Publication (Kokai) No. 2003-131230, there is disclosed a display unit that obtains a narrow viewing angle characteristic by using a prism sheet almost meeting with an optical property in a viewing angle being narrowed. Moreover, in Japanese Unexamined Patent Publication (Kokai) No. 2004-318112, there is disclosed a liquid crystal display provided with a look-up table for controlling a driving voltage supplied to a liquid crystal panel for the purpose of providing a narrow viewing angle. Furthermore, in Rocket_SecurityShades, there is employed a method of controlling the viewing angle, in which a display gradation range is narrowed by not using gradation levels at both sides of higher gradation levels and lower gradation levels for the display, to thereby reduce visibility with respect to a large viewing angle.

According to the method disclosed in Japanese Unexamined Patent Publication (Kokai) No. 2003-295160, in order to adjust the distortion due to the viewing angle of the gradation curve, there is employed the method, in which a plurality of look-up tables to be referenced are prepared, and one pixel is further divided into a plurality of sub-pixels to thereby provide different gradation curves to respective sub-pixels. For this reason, according to the method disclosed in Japanese Unexamined Patent Publication (Kokai) No. 2003-295160, there has been such inconvenience that a configuration of a liquid crystal display panel has needed to be changed significantly, and in addition to that, contrast characteristics with respect to the viewing angle might not be necessarily controlled sufficiently.

Meanwhile, according to achieving the narrow viewing angle using the prism sheet described in Japanese Unexamined Patent Publication (Kokai) No. 2003-131230, a configuration of an LCD panel needs to be changed, for example, by preparing the prism sheets with different dimensions or the like for respective LCD panels. Additionally, in the liquid crystal display for controlling the driving voltage of the LCD to provide the narrow viewing angle disclosed in Japanese Unexamined Patent Publication (Kokai) No. 2004-318112, in attempting to achieve the narrow viewing angle, there is employed the method of generating a gradation collapse in a diagonal viewing angle by increasing the driving voltage on a low gradation side. According to the method disclosed in Japanese Unexamined Patent Publication (Kokai) No. 2004-318112, in order to control the driving of the liquid crystal display, it is necessary to change the driving voltage of the LCD panel, so that there is such an inconvenience that flexibility to the liquid crystal display cannot be obtained, for example a dedicated driver for LCD is required.

Furthermore, also in the conventional art described in Rocket_SecurityShades, since the narrow viewing angle has been achieved by only reducing a gradation width to be displayed, contrast has wholly been decreased, so that there has been such an inconvenience that contrast at the time of being seen from the front has been decreased. Additionally, according to the method described in Rocket_SecurityShades, even when the LCD panel is seen from the large viewing angle, a displayed image will be visible to some extent, so that there is such an inconvenience that good privacy protection cannot necessarily be provided to the user.

Other than this, in order to narrow the viewing angle, there has been employed a method of pasting a film formed into a louver structure, the so-called privacy filter on the liquid crystal display panel or the like. However, this causes other problems, in that the user needs to purchase the privacy filter, mounting the privacy filter has been troublesome, the viewing angle has not been dynamically controllable in response to a user's request, brightness has been reduced, a film exchange has been required because of durability of the film, or the like, so that the method has not been able to provide sufficient visibility and permanency.

SUMMARY OF THE INVENTION

In view of the problems of the aforementioned conventional art, the present invention aims at improving adjustment effects on a viewing angle range by providing a steeper change in curve than before as to the viewing angle from a small viewing angle (front direction) to a large viewing angle (slant direction) with respect to a change in contrast according to a user's viewing angle to an LCD panel.

Moreover, the present invention aims at providing an information processing apparatus, a display control method, and a program for the same that can provide a curve with a steeper change in contrast than before against the aforementioned viewing angle.

As a result of the present inventors' earnest studies to solve the problems associated with the aforementioned conventional art, in an LCD panel in a TN (twisted nematic) mode, particularly when the user's viewing angle (here, viewing angle=an angle measured from a perpendicular to the screen of the LCD panel) has been large, the present inventors have found that a linearity between brightness and gradation level is abruptly lost particularly in a region where gradation levels are low, whereby the present invention has been made.

More specifically, according to the present invention, a liquid crystal display in the TN mode is provided with a color conversion table corresponding to color palette data with gradation levels lower than predetermined gradation levels for the predetermined gradation levels, wherein in response to a user's instruction, the color conversion table to be used is switched from a color conversion table in the normal mode to a reduced-color conversion table to which a narrow viewing field displaying mode is applied. For example, if N is the number of display gradations and M is a reduction factor, the reduced-color conversion table may be stored in an appropriate storage area of the information processing apparatus as a data structure, in which, for example, the color palette data provided by N/M are allocated to a plurality of the N/M gradations from gradation level 0 through (N-M) level. As a result of this, a color conversion with the color palette data of the N/M gradations is performed, for example, from the original N gradation to the N/M gradations. Here, N and M are positive integers: N normally has the value of a power of 2, such as 64 or 256, and M can be selected from integers smaller than N. In addition, according to the present invention, as for the reduction factor, each of the gradation levels of the number of display gradations N does not need to have the same reduction factor, but it may be appropriately changed according to an application and a specific embodiment. The color palette data may be reduced so that, for example, an M-fold reduction is achieved from the gradation level N-1 to the gradation level (N-A), and an L-fold reduction is achieved from the next (N-A-1) to (N-A-B).

According to a preferred embodiment of the present invention, the reduced-color conversion table may have a data structure where, for example, when the viewing angle is large, higher gradations among the N gradations are associated with the color palette data of the lower gradations whose linearity between brightness and gradation level is lost, sequentially from the highest gradation. In other words, according to the present invention, visibility in a position where the viewing angle is large is reduced not by cutting the display gradations, but by utilizing a decrease in linearity between brightness and gradation level in the low gradations with the use of the reduced-color conversion table which is reduced so that the number of gradations may be N/M.

According to the aforementioned configuration of the present invention, as compared with the visibility control with respect to the conventional viewing angle, it is possible to provide a contrast curve having a higher peak to a front direction than that of the conventional way. As a result of this, it is possible to provide an information processing apparatus and a display control method, which can reduce the visibility in the large viewing angle with hardly affecting the visibility in the front direction, and use the LCD panel driven in the TN mode across wide ranges of viewing angle, and a program which causes the information processing apparatus to execute this display control method.

Thus, the information processing apparatus according to the present invention includes second software that receives a display mode changing instruction to pass a display control of an LCD panel to first software from the CPU 12 and a plurality of display control tables 38, in which color palette data of 128 or less gradation levels are reduced and allocated to higher gradation levels, wherein a reduced-color conversion table associated with a corresponding identification data is searched for from identification data of the LCD panel obtained by the first software to which the control is passed or the second software. A display adapter 30 reads out the reduced-color conversion table searched for from a display control table storing section 36 to a look-up table (LUT) reading section 40, and generates an RGB signal with reduced gradations.

Hereinafter, the present invention will be explained using embodiments shown in the drawings, but the present invention is not limited to the embodiments described herein below.

The above, as well as additional purposes, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further purposes and advantages thereof, will best be understood by reference to the following detailed description of an illustrative embodiment when read in conjunction with the accompanying drawings, where:

DETAILED DESCRIPTION OF THE PRESENT INVENTION

Figure 1:
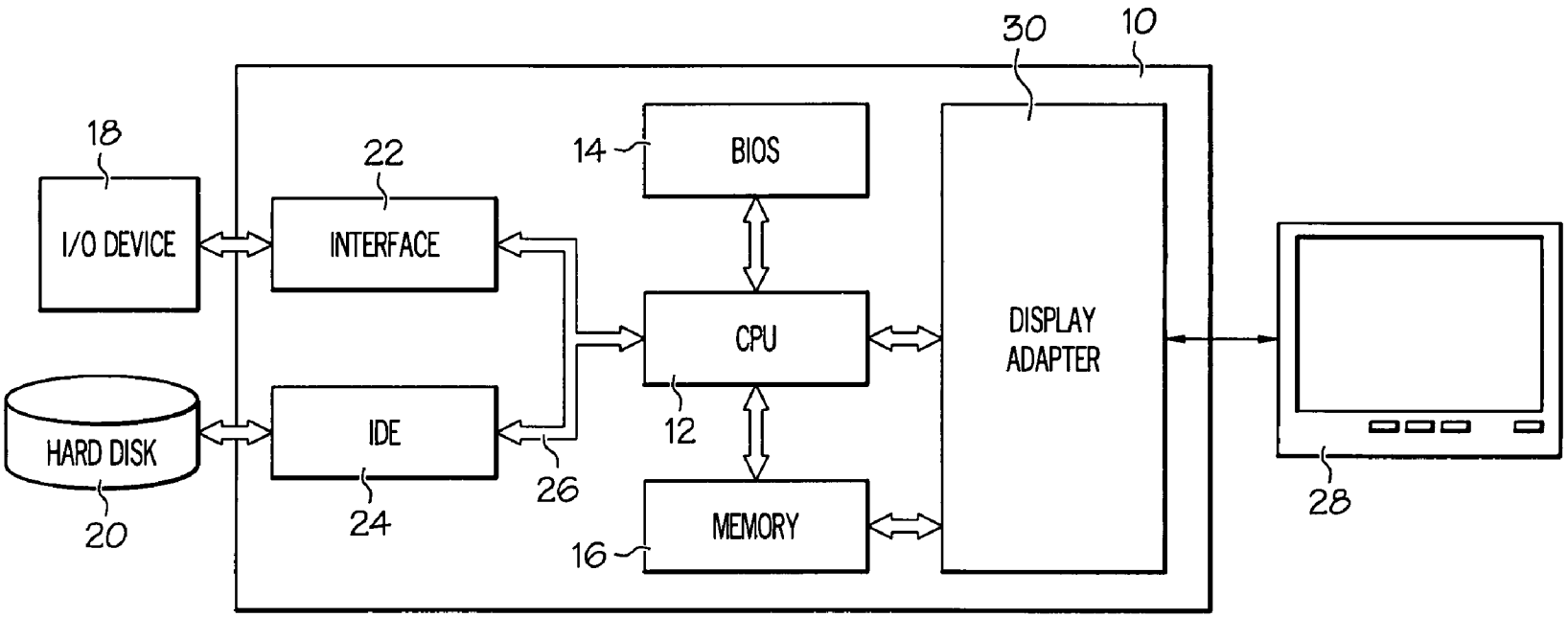
FIG. 1 is a schematic block diagram of an information processing apparatus according to the present invention.

FIG. 1 is a schematic block diagram of an information processing apparatus according to the present invention. An information processing apparatus 10 shown in FIG. 1 executes an application, and includes a CPU 12 for controlling a display, storage, input/output operation, or the like, a BIOS 14 which executes an input/output control of the information processing apparatus and is stored in a ROM, EEPROM, flash memory, or the like, and a memory 16 for storing execution data executed by the CPU 12, and image data to be displayed. The information processing apparatus 10 further includes an I/O device 18, such as a keyboard, a printer, or the like, and a hard disk 20, and both of them are interconnected to the information processing apparatus 10 via an appropriate interface 22 such as a USB, or an interface such as an IDE (Integrated Drive Electronics) 24. In addition, respective function means in the information processing apparatus 10 are interconnected through an internal bus line 26 and transmit data between the respective function means.

A display unit 28 provided with an LCD panel is further connected to the information processing apparatus 10, whereby the display unit 28 receives a video signal from the CPU 12 and the memory 16 via a display adapter 30 in the information processing apparatus 10 and then performs an RGB display on the LCD panel. The information processing apparatus 10 according to the present invention may be a portable laptop computer or notebook computer in particular, a mobile phone, or a PDA, and the display unit 28, in the case of the laptop computer or the notebook computer, is openably and closably attached to the information processing apparatus 10. Meanwhile, when the present invention is incorporated in the mobile phone or a PDA, it may be integrated with the information processing apparatus 10. It should be noted that the LCD panel according to the present invention is an LCD panel that operates in a twisted nematic (TN) mode.

Figure 2:
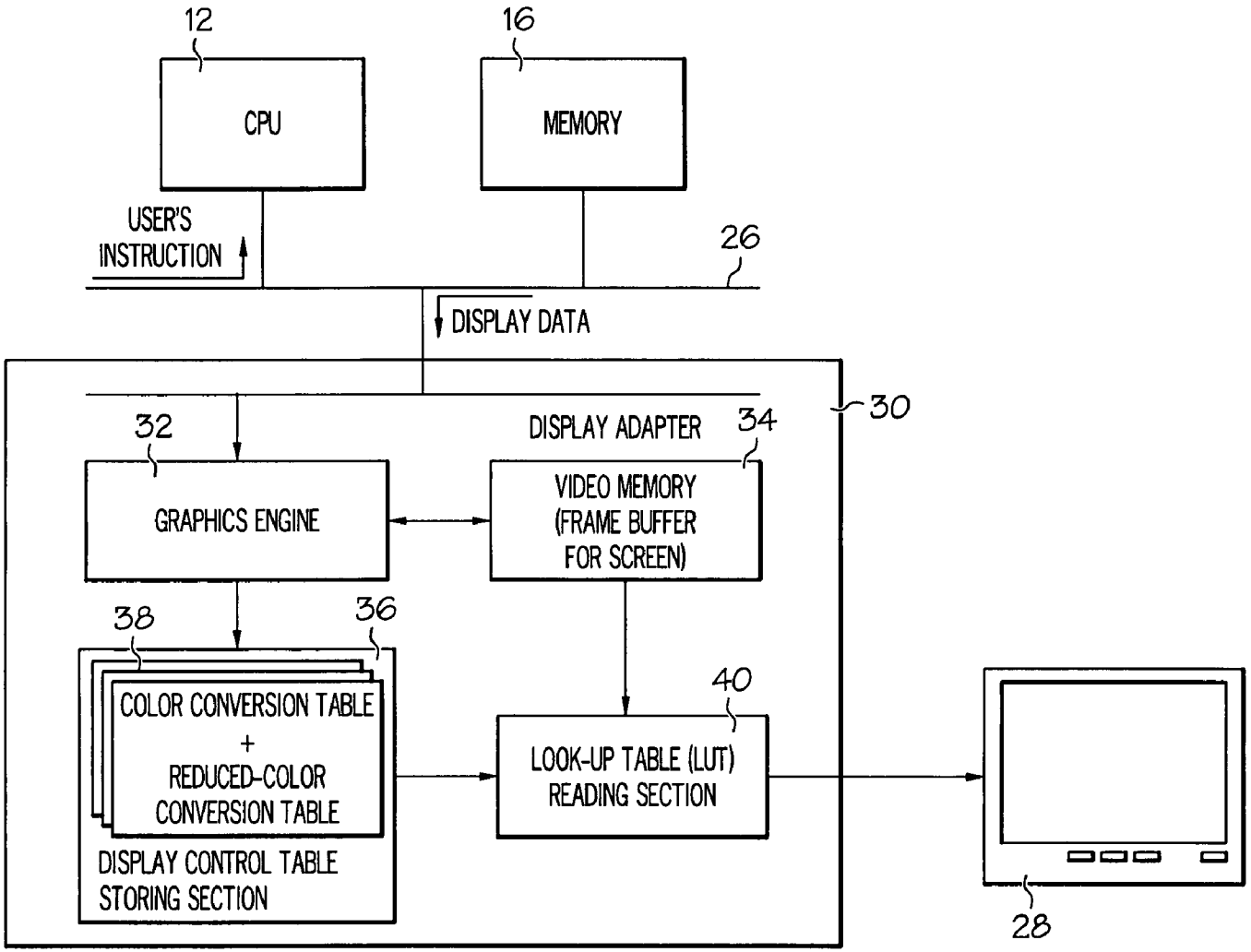
FIG. 2 is a block diagram showing a detailed configuration of a display adapter 30 according to the present invention.

FIG. 2 is a block diagram showing a detailed configuration of the display adapter 30 according to the present invention. As shown in FIG. 2, the display adapter 30 according to the present invention is interconnected to the CPU 12 and the memory 16 through the internal bus line 26. The memory 16 transmits data to be displayed to the display adapter 30 via a dedicated bus, such as an AGP bus of, for example 2×, 4×, 8×, or the like.

More specifically, the display adapter 30 includes a graphics engine 32 which is a CPU for executing rendering processing, a video memory (frame buffer for image) 34 for temporarily storing an frame image processed by the graphics engine 32 until it is displayed, and in a specific embodiment according to the present invention, a look-up table (LUT) reading section 40 for reading a display control table 38 composed of a reduced-color conversion table and a color conversion table stored in a display control table storing section 36 including an erasable memory device, such as an EEPROM, flash memory, or the like, to thereby generate RGB data to be displayed. The look-up table (LUT) reading section 40 generates the RGB data to be displayed, with reference to the display control table 38 having been read. Generated RGB data are sent to the display unit 28 to display an RGB image on the LCD panel.

According to the present invention, the display control table 38 has a data structure including a reduced-color conversion table for normal mode, and one or more types of reduced-color conversion tables for narrow viewing field displaying mode, for every identification data for specifying a type of the display unit 28 to be connected, where a plurality of tables are prepared associated with the types of the corresponding LCD panel. Moreover, as for the reduced-color conversion tables included in the display control table 38, as will be described later in the present invention, it is also possible to prepare two or more types of reduced-color conversion tables, which correspond to the viewing angle control according to a plurality of gradation levels and are different in reduction factors for every predetermined LCD panel. Upon receiving a user's instruction to select the narrow viewing field displaying mode via a utility software allocated to a function key or a dedicated button, the CPU 12 activates the BIOS to pass control of the display unit to a display device driver which will be described later, and selects the corresponding display control table 38 with reference to the identification data of the display unit 28. A selected reduced-color conversion table is read by the look-up table (LUT) reading section 40, and RGB data are generated with reference to the reduced-color conversion table.

Moreover, according to another embodiment of the present invention, when it is intended that the display control method according to the present invention is included in a manufacturing stage of the information processing apparatus, the reduced-color conversion table may be stored in a reduced-color conversion table storing section, which is provided apart from the color conversion table in the normal mode and composed of a memory, such as a ROM, EEPROM, or the like. In this case, when there is a display mode switching instruction from the user, the display device driver can provide the reduced-color conversion table to the display control table storing section 36 of the display adapter 30 shown in FIG. 2 from the reduced-color conversion table storing section which is not shown.

Figure 3:
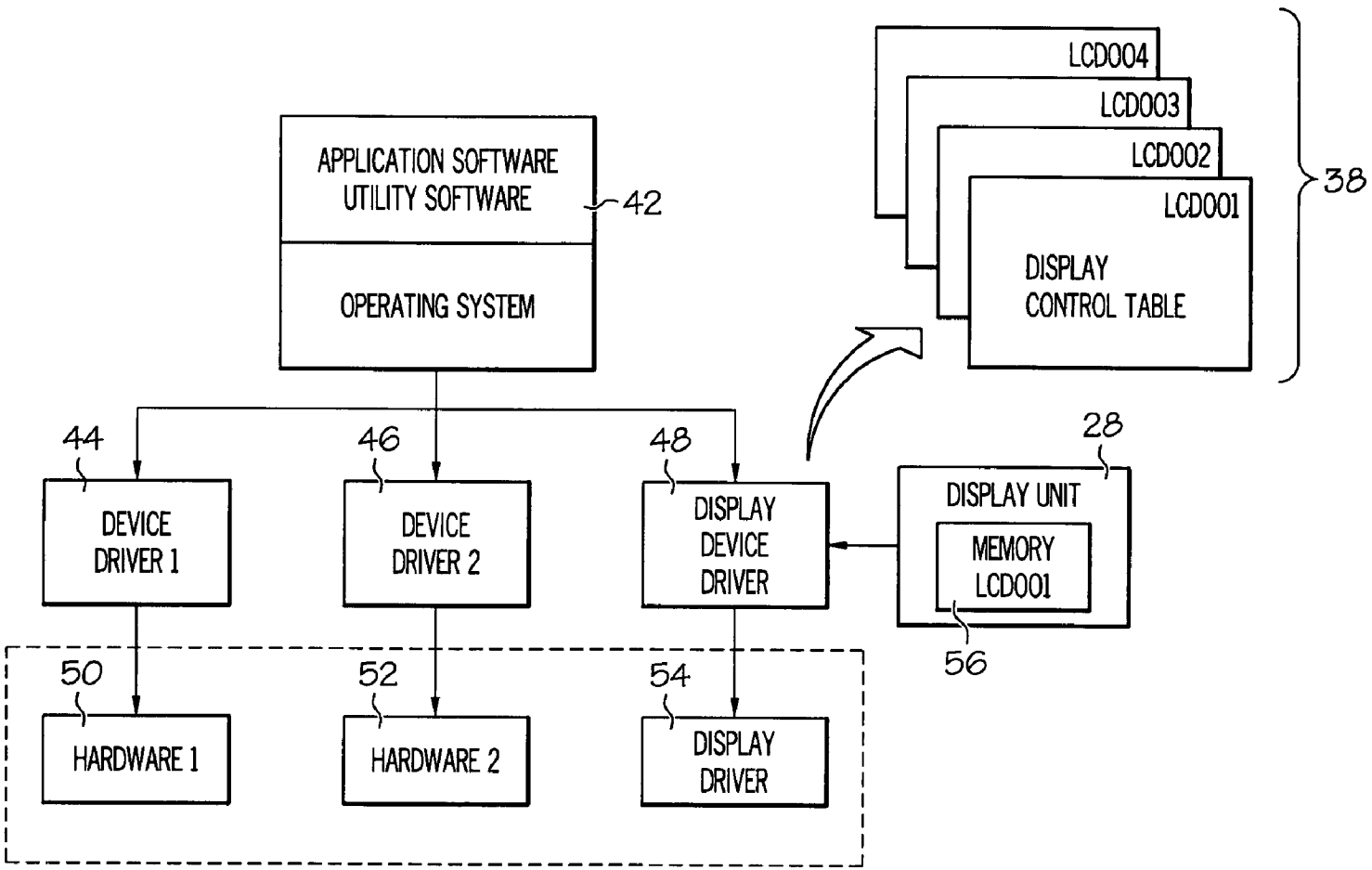
FIG. 3 is a schematic diagram showing a software/hardware configuration according to the present invention.

FIG. 3 is a schematic diagram showing a software/hardware configuration according to the present invention. The software configuration according to the present invention includes, from a side closer to the user, application software (utility software) 42 that operates on an operating system, and a plurality of device drivers 44, 46, and 48. The application software 42 receives an input from the user to execute processing requested by the user under management of the operating system, and displays the result on the display unit 28 to thereby display it to the user.

The aforementioned application software 42 includes not only word processor software, mail software, or the like, but also database software, various kinds of utility software, or the like. Meanwhile, the operating system includes not only various kinds of operating systems beginning with Windows (registered trademark), but also operating systems, such as MacOS™, OS/2, or the like, which are used for a laptop and notebook PC, a mobile phone, or a PDA.

In addition, according to the present invention, the device drivers 44 through 48 may be included as a software module of the operating system. In this case, the reduced-color conversion table used in the present invention may be stored in the reduced-color conversion table storing section provided by securing an appropriate memory in the system. Moreover, according to the present invention, as the program for executing the narrow viewing field displaying mode of the present invention, software different from the operating system may be used. When the software different from the operating system is provided as the program for executing the display method of the present invention, the user independently prepares device driver software for the present invention to install it in the information processing apparatus, thereby making it possible to incorporate the above software in the information processing apparatus. In this case, the reduced-color conversion table is first stored in a hard disk along with the display device driver, and then transferred to be stored in the memory 16 or the like at the time of activation, and in response to the user's instruction, read to the look-up table (LUT) reading section 40.

Further, the device drivers 44 through 48 control hardware devices 50 through 54 shown by the broken line in FIG. 3, respectively, and cause the respective hardware devices 50 through 54 to execute the processing based on the user's instruction. In addition, according to the embodiment shown in FIG. 3, the display unit 28 includes a memory 56, such as a ROM, as a memory device. Identification data and optimal display gradation information of the LCD panel used by the display unit 28 are stored in the memory 56, and the identification data and the optimal display gradation information are read to the display device driver 48, thus allowing the corresponding reduced-color conversion table to be searched. Moreover, according to another embodiment of the present invention, a memory device such as the memory 56 may be a storage area secured in an appropriate area of the information processing apparatus.

In the specific embodiment according to the present invention shown in FIG. 3, upon receiving a display mode switching instruction from the user, the display device driver 48 reads the identification data and the optimal number of display gradations for specifying a form of the LCD panel, from the display unit 28. According to the embodiment shown in FIG. 3, a reduced-color conversion table 38*a* is included as a data object used by the display device driver, and the reduced-color conversion table 38*a* associated with the LCD panel concerned is selected from an appropriate storing region of the memory 16.

Figure 4A:
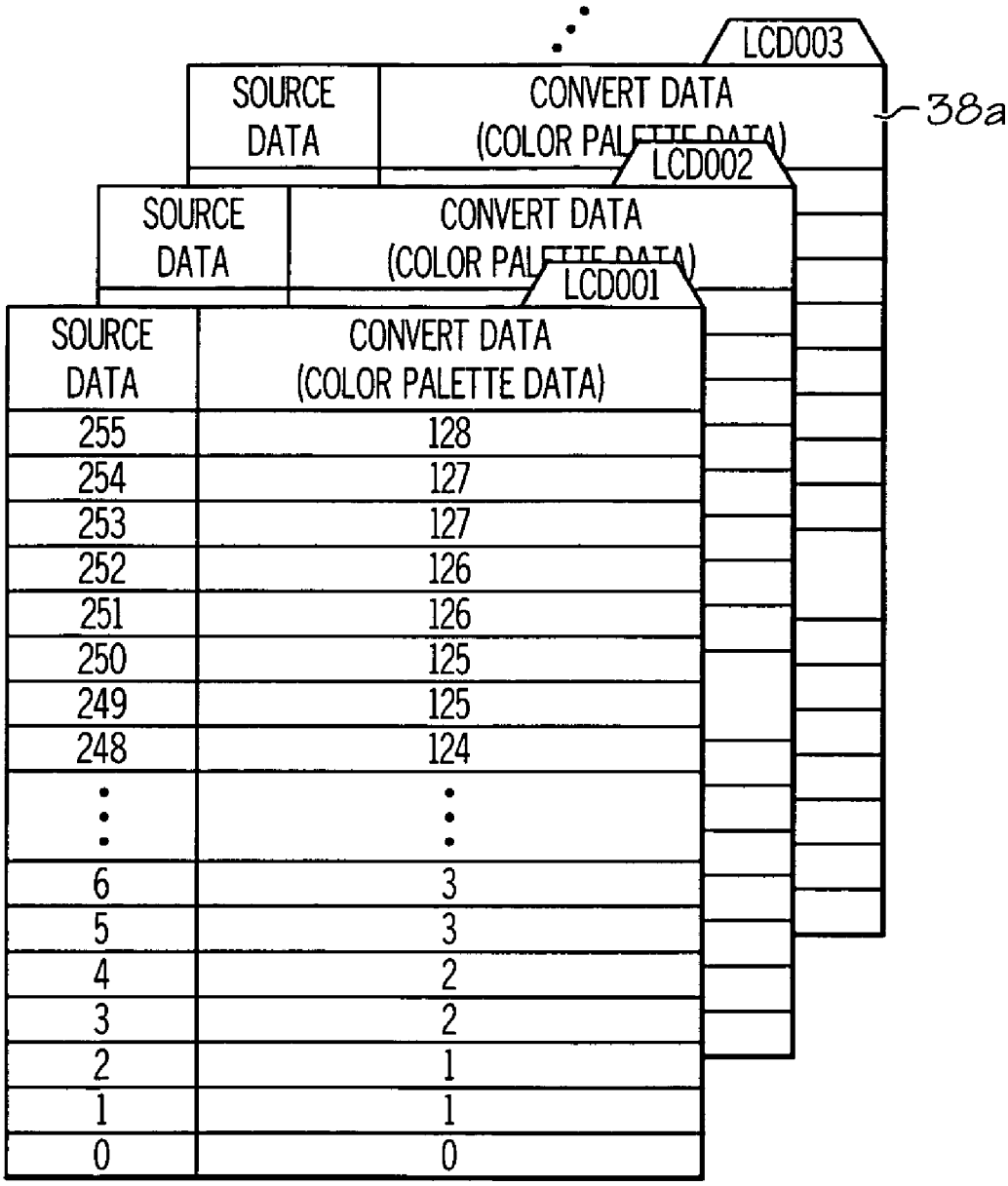
FIGS. 4*a-b* are diagrams showing an embodiment of a display control table according to the present invention.
Figure 4B:
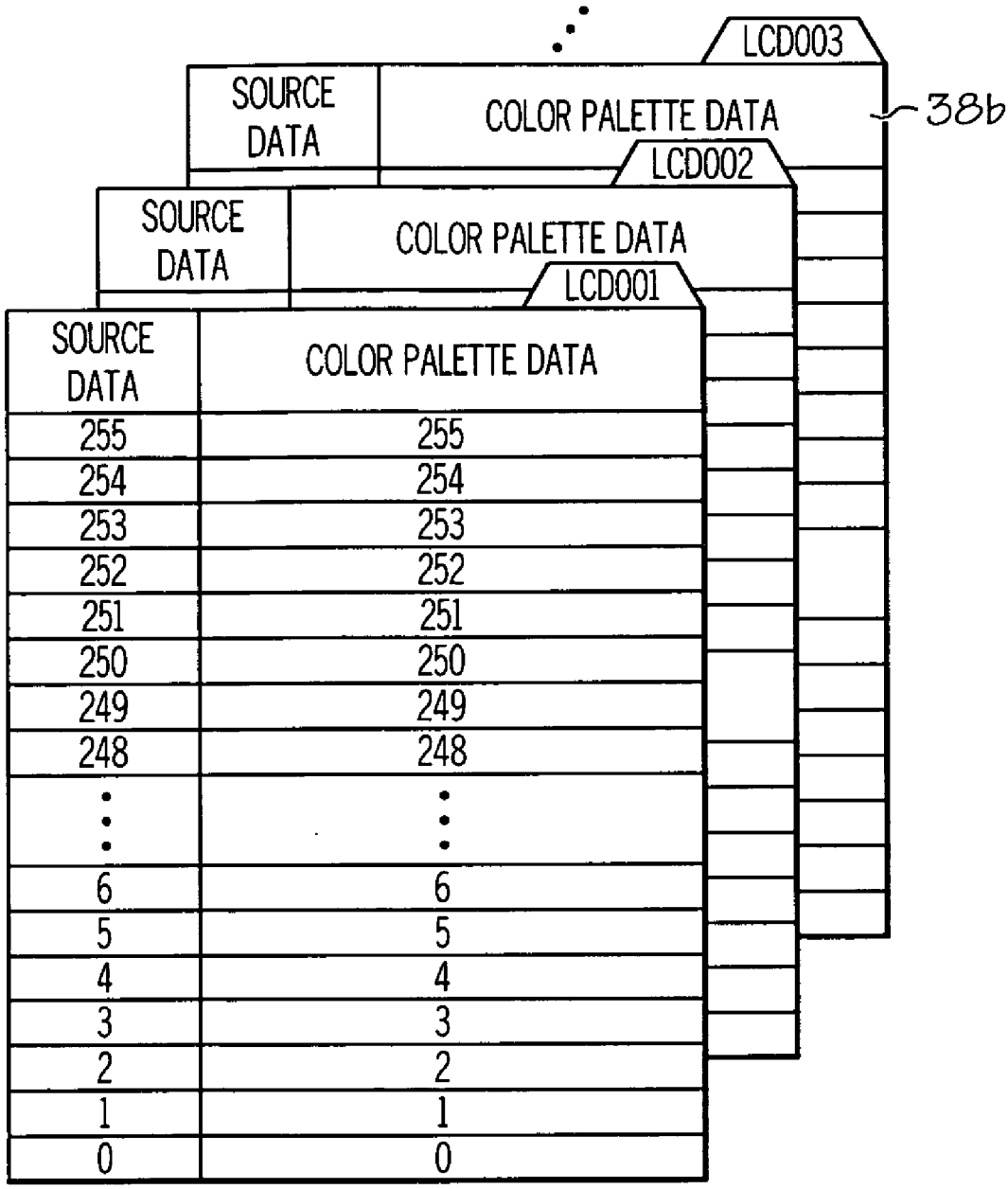

FIG. 4 shows an embodiment of the display control table 38 according to the present invention. FIG. 4A is the reduced-color conversion table 38*a*, and FIG. 4B is a normal display color conversion table 38*b*. As explained on FIG. 3, the reduced-color conversion table 38*a* is tagged based on the identification data of the LCD panel and a level of a viewing angle adjustment, which are associated with each of the plurality of reduced-color conversion table data. In addition, source data represents the number of display gradations specified by the user or the optimal number of display gradations of the LCD panel, and in recent years, may be gradation data of 64 gradations or 256 gradations in many cases. Immediately after the information processing apparatus 10 is activated by the user, RGB conversion is first performed with reference to the normal display color conversion table 38*b*, shown in FIG. 4B, to which the color palette data corresponding to the number of gradations of the source data such as, for example, 256 gradations are registered, and the display is then performed. The display control table according to the present invention may be stored integrally with or independently of a plurality of different software applications such as, for example, a BIOS and a Video BIOS. Further, when available from the implementation point of view, the display control table 38 may be stored in any storage devices of the information processing apparatus along with any software.

Meanwhile, an embodiment of the reduced-color conversion table 38*a* illustrated in FIG. 4 is explained below. In the narrow viewing field displaying mode according to the present invention, the reduced-color conversion table shown in FIG. 4A obtained by reducing the gradation is selected. Reducing the gradation according to the present invention means to allocate the same color palette data of 128 or less gradations in the present example to a plurality of gradation levels which are successive and different. In other words, according to the present invention, the color palette data for displaying J gradations are substantially allocated to the source data with N gradations. In the embodiment shown in FIG. 4, there is shown the reduced-color conversion table, in which the source data with 256 gradations are doubly reduced to 128 gradations, where N=256 and J=128 as an example.

In the embodiment illustrated in FIG. 4, it is also shown that the color palette data are allocated so that the display may be reduced to N/2 gradations to achieve a reduction for every 2 gradation levels. It should be noted that, according to the present invention, the number of gradations and the reduced level of the source data are not limited to those of the embodiment of reducing 256 gradations to 128 gradations, but may be adjusted to be any number of gradations and reduced level so that an appropriate display may be accordingly provided.

Figure 5A:
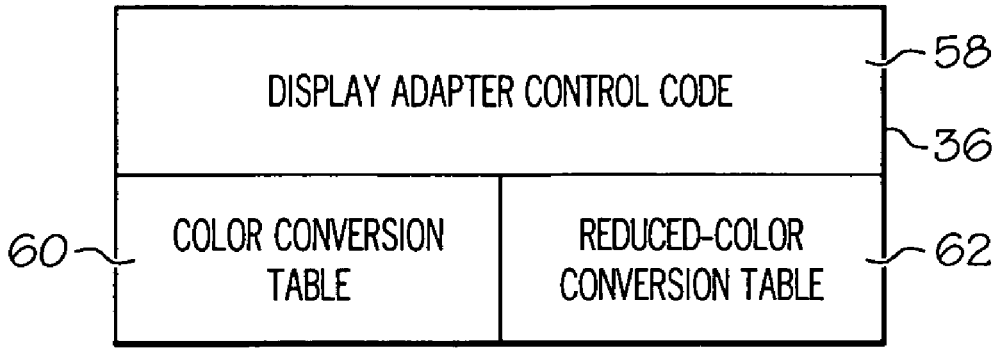
FIGS. 5*a-b* are illustrations showing a storage mode of a color conversion table and a reduced-color conversion table according to the present invention.
Figure 5B:
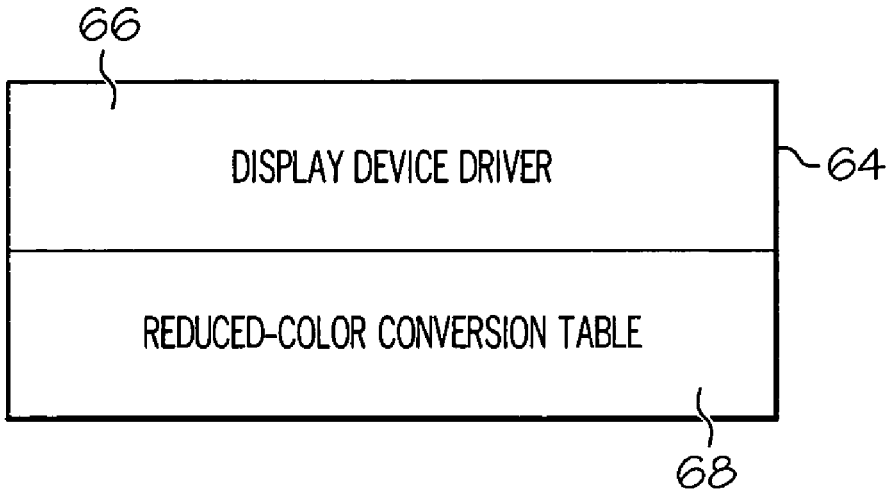

FIG. 5 shows an illustration of a storage mode of the reduced-color conversion table for providing a display with the narrow viewing angle according to the present invention. FIG. 5A is an embodiment where the normal display color conversion table 38*b* and the reduced-color conversion table 38*a* are stored in the memory for storing the display control table storing section 36, and FIG. 5B is an embodiment where only the reduced-color conversion table 38*a* is stored in the main memory 16 along with the display device driver. In FIG. 5A, for example, in the Video BIOS, a control code 58 such as a graphics engine, a memory area 60 for storing the color conversion table for providing the display in the normal mode, and a memory area 62 for storing the reduced-color conversion table for providing the display with the narrow viewing angle are formed. It would be appreciated that this embodiment may be applied to cases where a manufacturer of the information processing apparatus provides the narrow viewing field displaying mode of the present invention as firmware and where the Video BIOS is updated by a method of a BIOS update or the like.

In the normal mode, the Video BIOS selects the color conversion table of the normal mode stored in the memory area 60 as the color conversion table used by the graphics engine 32, and passes the selected color conversion table to the look-up table (LUT) reading section 40, so that the display control in the normal mode is executed. Meanwhile, when receiving an instruction to display in the narrow viewing field displaying mode from the display device driver 48, the Video BIOS changes a read address area to the memory area 62, selects the reduced-color conversion table corresponding to the instructed identification data, the optimal number of display gradations, or the like, and passes it to the look-up table (LUT) reading section 40, so that the display control in the narrow viewing field displaying mode is executed.

Meanwhile, in the embodiment shown in FIG. 5B, the display device driver 48 is stored in the hard disk 20, or a memory device such as a bulk memory in the case of a PDA, a mobile phone, or the like, which does not include any hard disk, and upon activating the information processing apparatus, is readout to the appropriate memory area 64 of the memory 16 which serves as a main memory. Further, the memory area 64 includes a memory area 66 for storing the display device driver 48 and a memory area 68 for storing the reduced-color conversion table. The display device driver 48 is registered to the operating system. Upon receiving a system call from the application software, utility software, or the like, or a display command in the narrow viewing field displaying mode from a device driver interface (DDI) or the like, the display device driver 48 is passed the control of the display unit by the BIOS, selects the color conversion table or the reduced-color conversion table associated with an identification data and the optimal number of display gradations of the corresponding LCD panel with reference to an address of the memory area 68, and passes the selected table to the display adapter 30, thus allowing the display control in the narrow viewing field displaying mode.

A twisted nematic (TN) display is a liquid-crystal display (LCD) that has two plates of polarized glass, between which is confined a substance called a nematic liquid crystal. The nematic liquid crystal rotates the polarization of light beams passing through it. Two polarizing filters (an input filter and an output filter), which are parallel planes of glass with their polarizing lines oriented at right angles with respect to each other, are positioned on either side of the nematic liquid crystal. When light enters the TN display, the light is polarized by the input filter. In the absence of an electric field, all the incoming light is passes through the TN display. This is because the light polarization is rotated 90 degrees by the nematic liquid crystal, and the light therefore passes easily through the output filter, which is oriented to match the 90-degree shift. With the application of a voltage, an electric field is produced in the nematic liquid crystal. Under these conditions the polarization effect is reduced. If the voltage is large enough, the polarization effect disappears altogether, and the light is blocked by the output polarizing filter. Thus, the present invention, in a preferred embodiment, is directed to a display that uses a TN display, and thus display drivers are in "TN mode."

Figure 6:
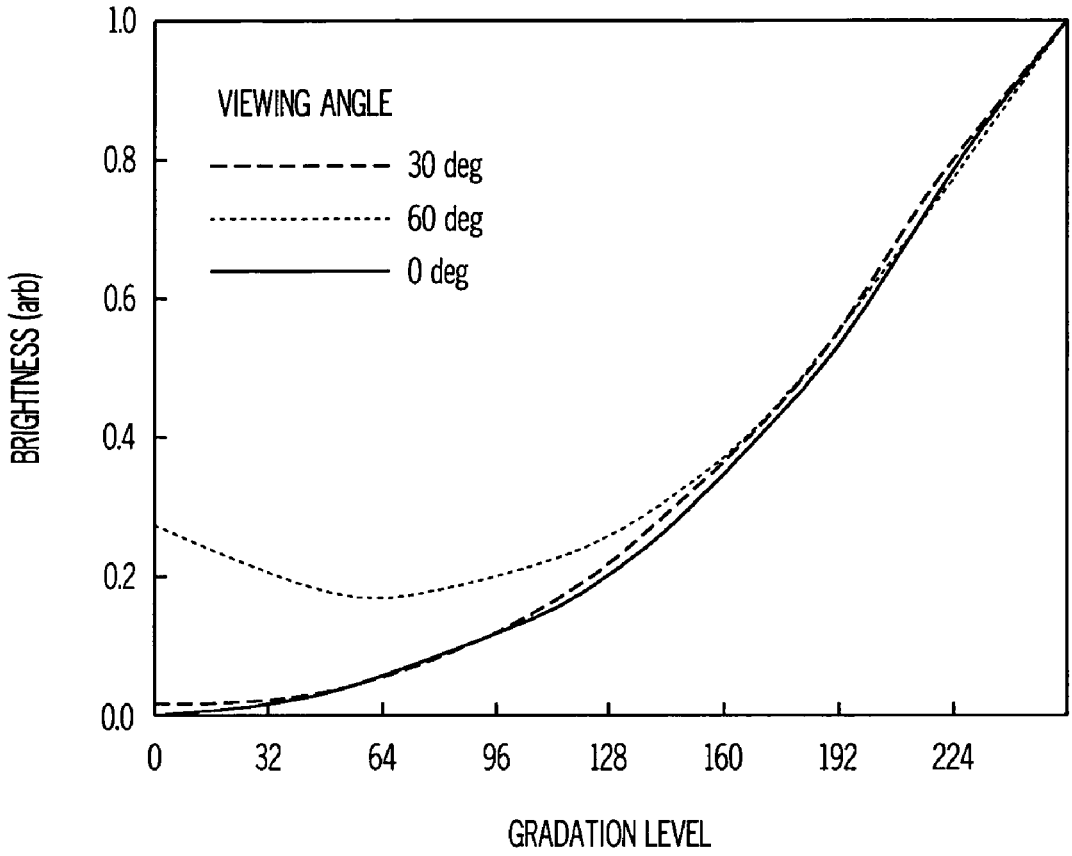
FIG. 6 is a graph for explaining a function mechanism according to the present invention, where brightness and gradation levels are plotted with respect to various viewing angles.

FIG. 6 is a graph in which brightness and gradation levels of the LCD panel driven in the TN mode are plotted with respect to various viewing angles for the purpose of explaining a function mechanism according to the present invention. In FIG. 6, a solid line represents a brightness-gradation curve in 256 gradations where the viewing angle=0 degree, a broken line ( - - - ) represents a brightness-gradation curve where the viewing angle=30 degrees, and a dotted line ( . . . ) represents a brightness-gradation curve where the viewing angle=60 degrees. As shown in FIG. 6, it will be understood that when the viewing angle is 30 degrees or less, there are no significant changes in the brightness-gradation curve, but when the viewing angle becomes 60 degrees, the brightness is increased especially on the low gradation side; in short, the screen goes white and looks as if it were floating. As will be understood, it is shown that, in a region with a small viewing angle, the brightness control corresponding to the gradation is sufficiently made even in a portion with low gradation levels. It is also shown that, in order to reduce the visibility in a region with a large viewing angle, it is effective to reduce the gradation levels toward the side with the low gradation levels.

Figure 7:
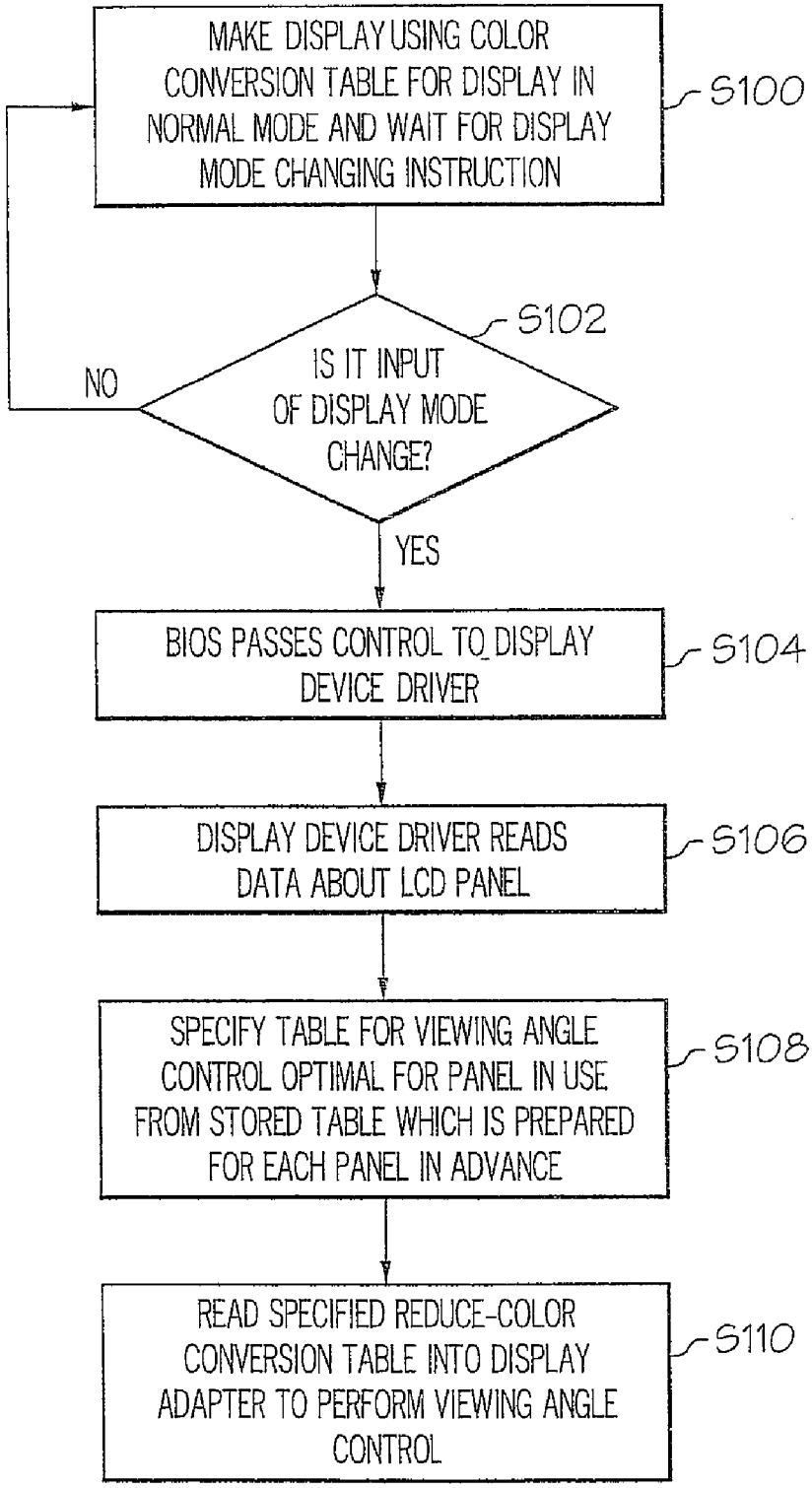
FIG. 7 is a process flow chart showing a display change method according to the present invention.

FIG. 7 is a process flow chart showing a method of changing the display mode according to the present invention. In the flow chart shown in FIG. 7, at Step S100, while performing the display in the normal mode using the normal display color conversion table 38*b*, the process waits for a display mode changing instruction from the user. At Step S102, it is determined whether or not the display mode changing instruction is supplied, and if the display mode changing instruction is not supplied (NO), the process returns to Step S100 to wait for the display mode changing instruction. According to the present invention, the display mode changing instruction causes a search for a reduced-color display table not only corresponding to the reduction factor included in the display mode changing instruction but also corresponding to the identification code and the optimal number of display gradations of the LCD panel being used among a plurality of prepared reduced-color conversion tables with different reduction factors to make the look-up table (LUT) reading section 40 read it.

Meanwhile, when the display mode changing instruction is allocated to a specific function key for the code of the display mode switching instruction of the present invention, an instruction on a display mode change is issued (YES) by a user's operation of depressing the specific function key, and the BIOS passes the control of the display unit to the display device driver at Step S104. Subsequently, at Step S106, the display device driver reads the identification data and the optimal number of display gradations of the LCD panel stored in, for example the ROM or the like from the memory device of the display unit or an appropriate memory area of the information processing apparatus.

Subsequently, at Step S108, by retrieving the reduced-color conversion tables 38*a*, which are stored in the BIOS with the identification data and the optimal number of display gradations obtained by the display device driver as keys or held as data by the display device driver, a corresponding reduced-color conversion table for the relevant LCD panel is selected. At Step S110, the selected reduced-color conversion table is read to the display adapter, and thereby an RGB signal corresponding to the narrow viewing field displaying mode is generated to display the image on the LCD panel.

Hereinafter, the present invention will be explained using an embodiment. Incidentally, an embodiment with 64 gradations will be explained.

Figure 8:
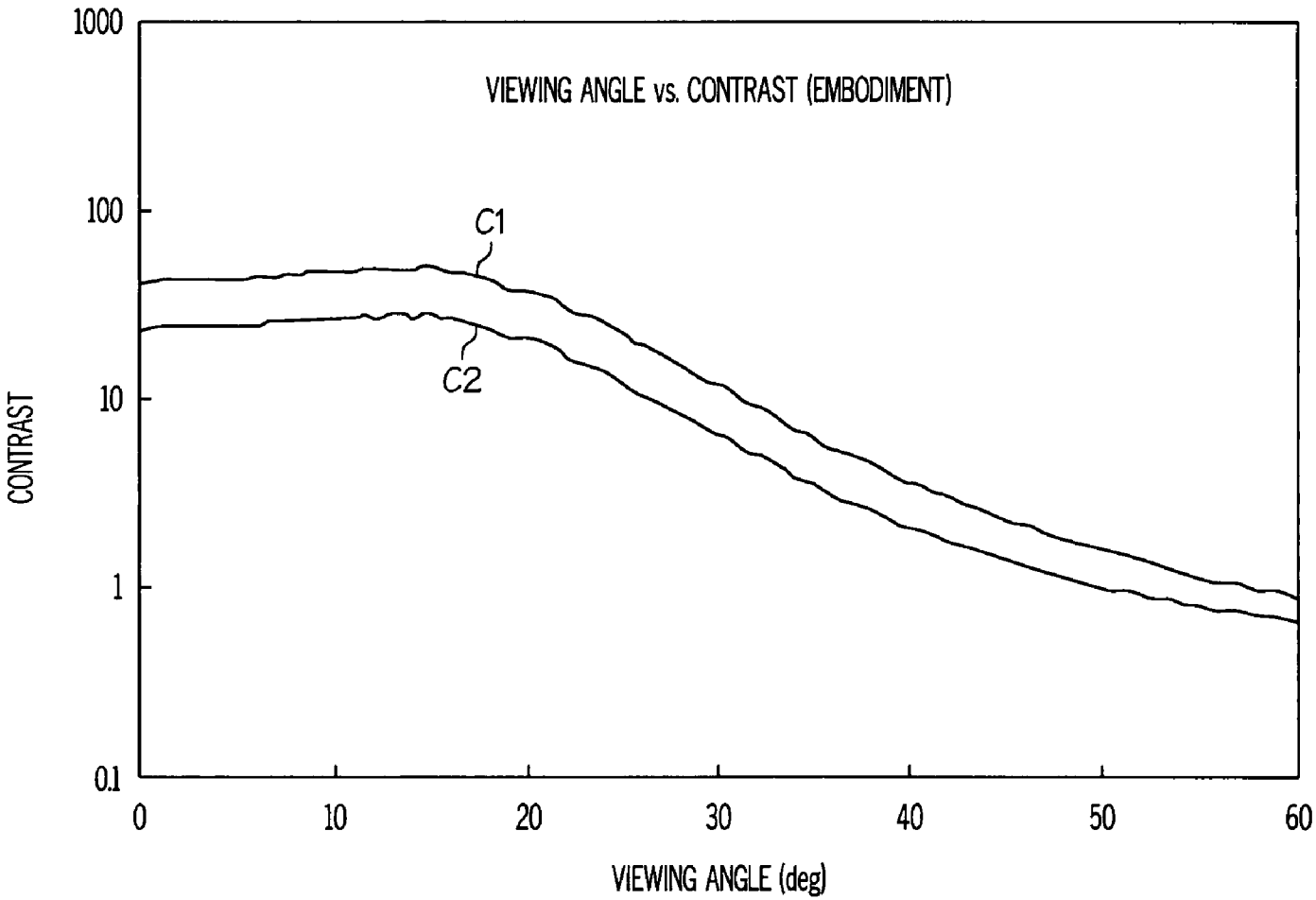
FIG. 8 is a graph in which a display characteristic (white/black contrast) obtained by the present invention is plotted with respect to the viewing angle when the embodiment is applied to a display of a 64-gradation full scale.

FIG. 8 is a graph in which a display characteristic (white/black contrast) obtained by the present invention is plotted with respect to the viewing angle in the case of applying it to a display of a 64-gradation full scale. In FIG. 8, curve C1 represents the display characteristic in the narrow visual field displaying mode in a two-fold reduction where 64 gradations are reduced to 32 gradations, and curve C2 represents a result in a three-fold reduction where 64 gradations are reduced to 23 gradations. As shown in FIG. 8, when the display is reduced toward the low gradation side according to the present invention, it is shown that the contrast is abruptly reduced from a point where the viewing angle exceeds about 20 degrees. This reflects the characteristic of the liquid crystal panel in the TN mode shown in FIG. 8 where the contrast is abruptly reduced on the low gradation side in the large viewing angle according to the present invention. For this reason, the contrast is abruptly reduced at a point where the viewing angle exceeds 20 degrees.

Moreover, selecting curve C1 or curve C2 may provide different viewing angle restriction effects, thereby making it possible for the user to perform the optimal viewing angle adjustment depending on usage situations.

Figure 9:
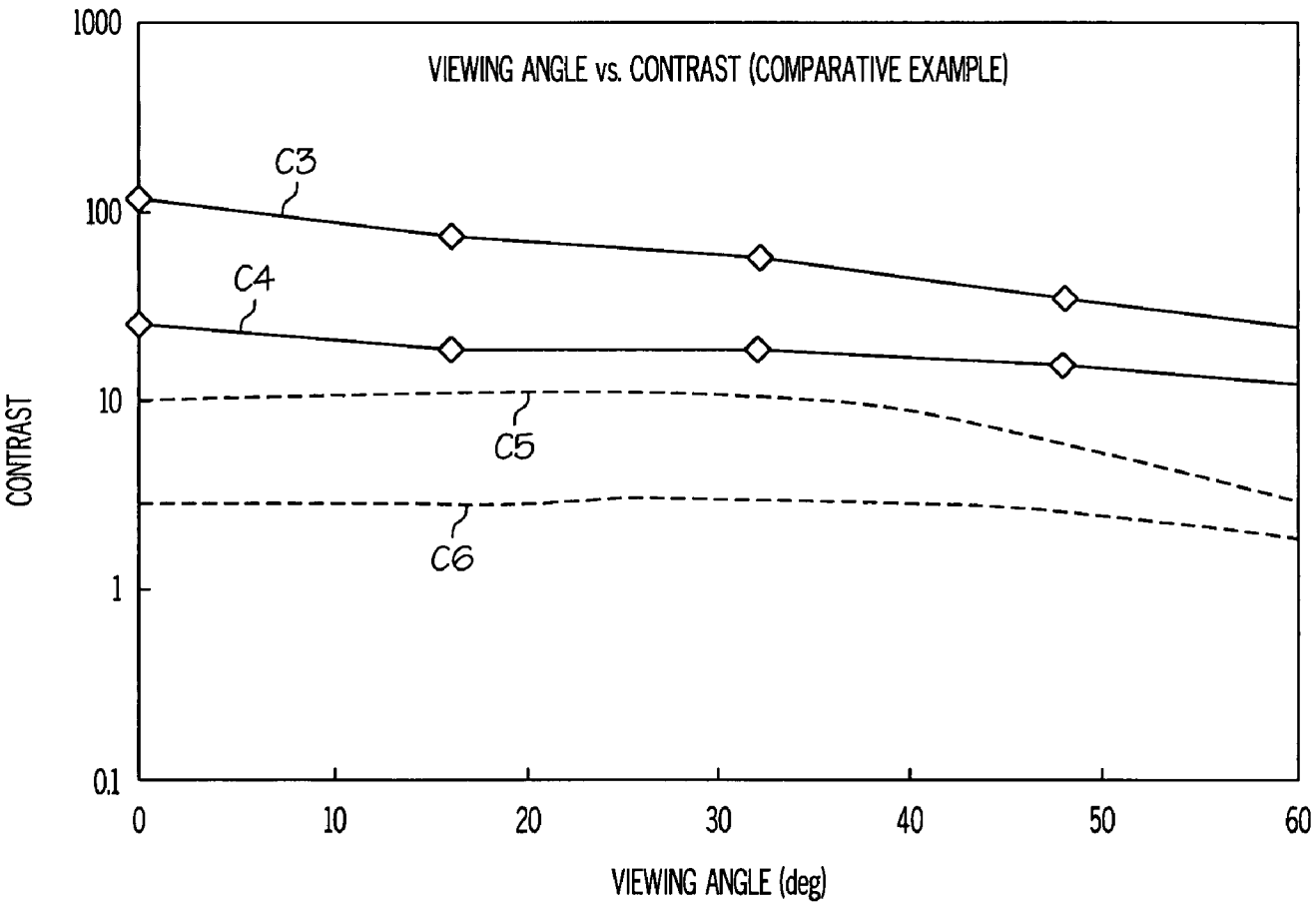
FIG. 9 is a graph showing contrast curves (C3: 32 gradations, C4: 16 gradations) obtained from an angle dependence of gradation characteristics obtained by the method of defining the gradation for every pixel, and contrast curves (C5: 47/15 gradations, C6: 39/23 gradations) obtained by the method of reducing a gradation range.

In FIG. 9, there are shown contrast curves (C3: 32 gradations, C4: 16 gradations) obtained from an angle dependence of gradation characteristics obtained by the method of defining the gradation for every pixel described in Japanese Unexamined Patent Publication (Kokai) No. 2003-295160, and contrast curves (C5: 47/15 gradations, C6: 39/23 gradations) obtained from Rocket_SecurityShades. As shown in FIG. 9, although the contrast is roughly reduced with respect to the viewing angle in either case, the curves show a monotonic decrease as compared with that of the embodiment of the present invention shown in FIG. 8. Particularly, the contrast curves obtained from the method disclosed in Rocket_SecurityShades do not effectively utilize the display characteristic of the liquid crystal panel in the TN mode. Due to the process for reducing 64 gradations only to a range of 47/15 gradations or a range of 39/23 gradations, the contrast curves show that a front contrast is remarkably reduced. Moreover, from a viewpoint of dependence on the viewing angle, they show that a characteristic where the contrast hardly changes is only provided even when the viewing angle is increased.

Figure 10A:
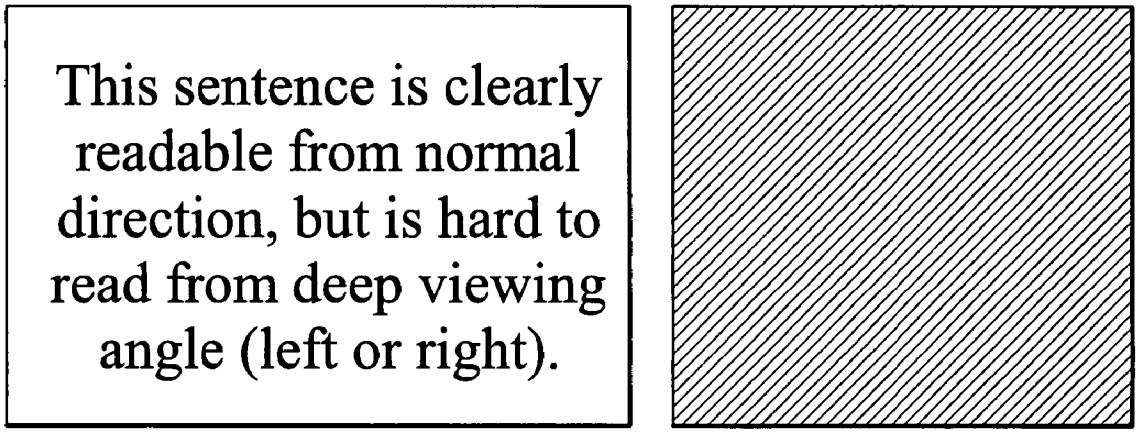
FIG. 10 is a diagram showing a comparison between the display control method according to the present invention and the conventional display control method.
Figure 10B:
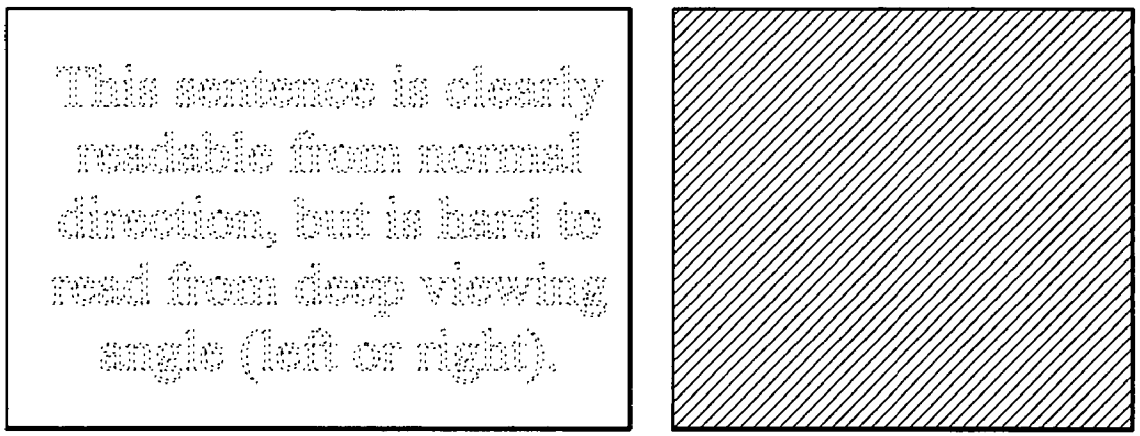

FIG. 10 is a diagram showing a comparison between the method of controlling the display mode according to the present invention and the method of controlling the display mode according to Rocket_SecurityShades. FIG. 10A shows screen displays obtained from the method of controlling the display mode according to the present invention, while FIG. 10B shows screen displays obtained from the method of controlling the display mode according to Rocket_SecurityShades. In both of FIGS. 10A and 10B, left side pictures on the paper are screen displays seen from the front side, and right side pictures on the paper are screen displays seen from the viewing angle of about 60 degrees. As shown in FIG. 10, in the narrow viewing field displaying mode according to the present invention, it is shown that the screen display seen from the front provides such a high contrast that hardly imposes on the user.

Meanwhile, in the method of controlling the display mode of Rocket_SecurityShades, it will be understood that even when the image is seen from the front, the contrast of the displayed image is considerably reduced to hardly be seen. Meanwhile, as will be understood, if the displays with the wide viewing angle are compared, the contrast is reversed in part, but the displayed image according to the present invention can be hardly read. According to the image obtained by the method of Rocket_SecurityShades, however, it is shown that when the image is seen from the front, although the contrast is reduced, the image can be read to some extent even when the viewing angle is wide.

The present invention may be used for the display control of, for example a laptop computer, a notebook computer, a PDA, a mobile phone, or the like, as far as it is a portable information processing apparatus using the liquid crystal panel driven in the TN mode. In addition, a program for causing the information processing apparatus to execute the display control method according to the present invention may be described using an object oriented programming language such as C and C++, or a non object-oriented programming language. Moreover, the display control method according to the present invention has so far been explained supposing that the display control is performed by the display device driver through the involvement of the BIOS, but all control may be performed by the BIOS, or all may be performed by the device driver. The method according to the present invention may be implemented by hardware using an LSI such as a graphics chip or the like, instead of software such as a device driver, thereby allowing more flexible viewing angle control to be provided.

It should be understood that at least some aspects of the present invention may alternatively be implemented in a computer-useable medium that contains a program product. Programs defining functions on the present invention can be delivered to a data storage system or a computer system via a variety of signal-bearing media, which include, without limitation, non-writable storage media (e.g., CD-ROM), writable storage media (e.g., hard disk drive, read/write CD ROM, optical media), and communication media, such as computer and telephone networks including Ethernet, the Internet, wireless networks, and like network systems. It should be understood, therefore, that such signal-bearing media when carrying or encoding computer readable instructions that direct method functions in the present invention, represent alternative embodiments of the present invention. Further, it is understood that the present invention may be implemented by a system having means in the form of hardware, software, or a combination of software and hardware as described herein or their equivalent.

As described above, according to the present invention, it is possible to provide the contrast curve that is versatilely applicable to the LCD panel in the TN mode, and in addition to that, has a peak particularly to a front direction as compared with the conventional visibility control to the viewing angle. Therefore, that makes it possible to reduce the visibility in the front direction across the large viewing angles, with hardly affecting the visibility, allowing an increase in the security to be achieved.

While the present invention has been explained using the embodiment shown in the drawings so far, the present invention is not limited to the embodiments shown in the drawings, but may be incorporated in the information processing apparatus as various improvements and modifications, and other embodiments.

The invention claimed is:

1. A data processing system comprising:

a central processing unit (CPU) for processing information;

a display unit provided with a liquid crystal display (LCD) panel operating in a twisted nematic (TN) mode; and a display adapter for controlling said display unit, wherein said display unit includes a display control table having a plurality of first color conversion tables for regulating normal mode operation of said display unit, and at least one second color conversion table corresponding to identification data of said LCD panel for regulating narrow viewing field displaying mode operation of said display unit, wherein said second color conversion table includes color palette data for displaying M gradations being allocated to corresponding source data with N gradations so as to satisfy a relationship of M<N.

2. The data processing system of claim 1, wherein said second color conversion table corresponds to a plurality of reduction factors associated with control levels of a viewing angle.

3. The data processing system of claim 1, wherein said display adaptor includes a look-up table for reading said display control table to generate RGB data to be displayed on said display unit.

4. A display control method comprising:

in response to a receipt of a display mode changing instruction for a liquid crystal display (LCD) panel operating in a twisted nematic (TN) mode, searching a plurality of second color conversion tables to select one that corresponds to identification data of said LCD panel for narrow viewing field displaying mode operation, wherein said selected one second color conversion table includes color palette data of low gradation levels allocated to a plurality of higher gradation levels, wherein said plurality of second color conversion tables include color palette data for displaying M gradations being allocated to corresponding source data with N gradations so as to satisfy a relationship of M<N; and generating color converted RGB signals corresponding to said low gradation levels using said selected second color conversion table.

5. The method of claim 4, wherein said plurality of second color conversion tables correspond to a plurality of reduction factor associated with control levels of a viewing angle.

6. The method of claim 4, wherein said method further includes reading a look-up table to generate said color converted RGB signals to be displayed on said LCD panel.

7. A computer-usable medium embodying computer program code for controlling viewing angle characteristics of a liquid crystal display (LCD), said computer-usable medium comprising:

computer program code for, in response to a receipt of a display mode changing instruction for said LCD panel operating in a twisted nematic (TN) mode, searching a plurality of second color conversion tables to select one that corresponds to identification data of said LCD panel for narrow viewing field displaying mode operation, wherein said selected one second color conversion table includes color palette data of low gradation levels allocated to a plurality of higher gradation levels, wherein said plurality of second color conversion tables include color palette data for displaying M gradations being allocated to corresponding source data with N gradations so as to satisfy a relationship of M<N; and computer program code for generating color converted RGB signals corresponding to said low gradation levels using said selected second color conversion table.

8. The computer-usable medium of claim 7, wherein said plurality of second color conversion tables include correspond to a plurality of reduction factor associated with control levels of a viewing angle.

9. The computer-usable medium of claim 7, wherein said computer-usable medium further includes computer program code for reading a look-up table to generate said color converted RGB signals to be displayed on said LCD panel.

* * * * *